US009523360B2

(12) United States Patent
Iwasaki et al.

(10) Patent No.: US 9,523,360 B2
(45) Date of Patent: Dec. 20, 2016

(54) GEAR PUMP AND GEAR PUMP OPERATING METHOD

(71) Applicant: Kobe Steel, Ltd., Hyogo (JP)

(72) Inventors: Shin Iwasaki, Hyogo (JP); Kazuo Iritani, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/246,176

(22) Filed: Apr. 7, 2014

(65) Prior Publication Data

US 2014/0369876 A1 Dec. 18, 2014

(30) Foreign Application Priority Data

Jun. 17, 2013 (JP) ..... 2013-126685

(51) Int. Cl.

| | |
|---|---|
| ***F04C 15/00*** | (2006.01) |
| ***F04C 2/14*** | (2006.01) |
| ***F01C 21/10*** | (2006.01) |
| ***F04C 14/26*** | (2006.01) |

(52) U.S. Cl.

CPC ..... *F04C 15/0026* (2013.01); *F01C 21/108* (2013.01); *F04C 2/14* (2013.01); *F04C 14/265* (2013.01); *F04C 2270/175* (2013.01); *F04C 2270/19* (2013.01); *F04C 2270/22* (2013.01); *F04C 2270/225* (2013.01); *F04C 2270/80* (2013.01)

(58) Field of Classification Search

CPC . F01C 21/0881; F01C 21/108; F04C 15/0026; F04C 2270/80; F04C 2/102; F04C 2/26; F04C 14/265; F04C 2270/19

USPC ..... 418/201.1, 1, 126; 417/410.3, 410.4

See application file for complete search history.

(56) References Cited

U.S. PATENT DOCUMENTS 2,929,331 A * 3/1960 Lorenz ..... F01C 21/02 418/135

2011/0256008 A1 10/2011 Hattori et al.

FOREIGN PATENT DOCUMENTS

| | | | | |
|---|---|---|---|---|
| DE | 102011075415 | A1 * | 11/2012 | ..... F04C 2/10 |
| GB | 358843 | A | 10/1931 | |
| GB | 2048385 | A | 12/1980 | |
| JP | H03-127092 | U | 12/1991 | |
| JP | 08-004663 | A | 1/1996 | |
| JP | 10-141247 | A | 5/1998 | |
| JP | 2000-009051 | A | 1/2000 | |
| JP | 2006-263764 | A | 10/2006 | |

(Continued)

OTHER PUBLICATIONS

English Machine Translation of DE 102011075415A1, Pub. Nov. 8, 2012; Bauer Michael.*

*Primary Examiner* — Mary A Davis
*Assistant Examiner* — Anthony Ayala Delgado
(74) *Attorney, Agent, or Firm* — Studebaker & Brackett PC

(57) ABSTRACT

In order to highly precisely adjust a gap between a bearing and a gear rotor by a simple configuration, a gear pump of the present invention includes: a casing that includes an inlet and an outlet; a pair of gear rotors each of which is formed by integrating a gear portion with a shaft portion and which is disposed so as to engage with each other inside the casing; a bearing portion that supports the shaft portion so that the gear rotor is rotatable, the bearing portion being movable in the thrust direction of the gear rotor; and a gap adjustment unit that moves the bearing portion in the thrust direction so as to adjust a gap between the gear rotor and the bearing portion.

7 Claims, 4 Drawing Sheets

(56) References Cited

FOREIGN PATENT DOCUMENTS

| | | | |
|---|---|---|---|
| JP | 2010-284654 | A | 12/2010 |
| WO | 2010/046976 | A1 | 4/2010 |

* cited by examiner

GEAR PUMP AND GEAR PUMP OPERATING METHOD

BACKGROUND OF THE INTENTION

Field of the Invention

The present invention relates to a gear pump and a gear pump operating method.

Description of the Related Art

For example, in a resin kneading granulator that granulates a kneaded resin into pellet, a gear pump is generally used as a pressure raising device that pressure-feeds a kneaded and melted resin to a screen or an extrusion die located at the downstream side of a kneader. The gear pump is formed so that a pair of gear rotors engaging with each other is provided inside a hollow casing (a pump casing), and is configured to pressure-feed a resin material received into the casing by using the gear rotors.

Incidentally, there is a need to increase the size or the speed of the gear pump in order to improve the productivity of the resin kneading granulator. However, when the gear rotor is increased in size or is rotated at a high speed in this way, heat is easily generated inside the pump, and the components are thermally expanded due to the generated heat. As a result, a gap between a gear rotor and a bearing is narrowed, and hence the smooth rotation of the gear rotor is disturbed.

For this reason, Japanese Patent Application Laid-Open No. 10-141247 discloses a gear pump capable of cooling a gear rotor or a hearing by circulating a cooling medium. In this way, when the gear rotor or the bearing is cooled, the thermal expansion of the components inside the pump may be suppressed. Further, when the components such as the gear rotor or the bearing are heated or cooled, the components extend and contract in a different way, and hence there is a need to adjust the gap between the gear rotor and the bearing.

In order to solve such a problem, Japanese Patent No, 3988258 discloses a technique of adjusting a gap formed between components inside a pump. That is in this technique, a driving shaft of a gear rotor protruding from a driving gear to the outside of a casing is provided with a gap adjustment mechanism that keeps a side clearance between the side surface of the driving gear and the casing so as to be uniform. When the side clearance is kept uniform by the gap adjustment mechanism, the gap between the bearing and the gear rotor disposed inside the pump and connected through the driving shaft is also kept uniform.

SUMMARY OF THE INVENTION

Incidentally, in the technique disclosed in Japanese Patent Application Laid-Open No. 10-141247, a cooling medium is caused to flow to the gear rotor or the bearing in the components provided in the gear pump. Then, in this technique, only the bearing or the gear rotor is cooled in accordance with the operation condition Or the type of resin material, and hence a problem may arise in that a large temperature difference occurs between such a member and the casing. In such a case, the gap between the gear rotor and the thrust surface of the bearing increases due to the thermal expansion difference between the components, and hence the gap between the bearing and the gear rotor is deviated from an allowable range in design.

For example, when the gap is lower than a lower-limit value of the allowable range in design, the bearing and the gear rotor are very close to each other, and hence a metal contact therebetween easily occurs. Further, when the gap of the bearing exceeds an upper-limit value of the allowable range, the bearing and the gear rotor are separated from each other too much, and the melted resin leaks. As a result, the pump efficiency of the gear pump is degraded.

In particular, when a relation between the gap and the pump efficiency is considered, the pump efficiency of the gear pump is proportional to cube of the gap as illustrated in the equation (1).

$$\eta = 1 - \left(\frac{h^3 \Delta P}{V \mu N}\right) \tag{1}$$

η: efficiency of gear pump h: gap (mm) between bearing thrust surface and gear rotor ΔP: differential pressure (MPa) before and after gear pump V: ejection amount (cc/rev) per revolution of gear pump μ: resin viscosity (Pa·s)

N: rotation speed (rpm) of gear pump

That is as understood from the equation (1), when the gap of the bearing is slightly deviated from the allowable range in the gear pump of the related art, there is a possibility that the pump efficiency may be abruptly degraded.

Further, in the gear pump, there is a need to replace or add an adjustment washer (shim) in order to adjust the gap between the bearing thrust surface and the gear rotor. Therefore, in the gear pump, the gap may not be adjusted during the operation, and the gear pump needs to be disassembled even when such a work is possible. As a result, a considerable amount of work needs to be performed.

Meanwhile, even in the gear pump of Japanese Patent No. 3988258, a configuration needs to be employed in which the driving shaft is projected from the driving gear to the outside of a housing and the projected driving shaft is provided with the above-described gap adjustment mechanism, and hence the configuration of the device easily becomes complex. Further, the side clearance adjustment mechanism may easily increase in size and the amount of the gap adjustment operation considerably increases.

The present invention is made in view of the above-described problems, and an object thereof is to provide a gear pump and a gear pump operating method capable of highly precisely adjusting a gap between a bearing and a gear rotor by a simple configuration.

In order to solve the above-described problems, the present invention employs the following technical means.

That is, the present invention provides a gear pump including: a casing that includes an inlet and an outlet; a pair of gear rotors each of which is formed by integrating a gear portion with a shaft portion and which is disposed so as to engage with each other inside the casing: a bearing portion that supports the shaft portion so that the gear rotor is rotatable, the bearing portion being movable in the thrust direction of the gear rotor; and a gap adjustment unit that moves the bearing portion in the thrust direction so as to adjust a gap between the gear rotor and the bearing portion.

The gap adjustment unit may include: a bearing temperature measurement unit that is provided in the bearing portion so as to measure the temperature of the bearing portion; a casing temperature measurement unit that is provided in the casing so as to measure the temperature of the casing: an operation unit that moves the bearing portion in the thrust direction; and a control device that controls the operation unit based on the temperature of the bearing measured by the bearing temperature measurement unit and the temperature of the casing measured by the casing temperature measurement unit.

The bearing temperature measurement unit may be attached to the inside of the bearing portion in the radial direction.

The casing temperature measurement unit may be attached to a portion facing the outer periphery of the gear portion in the casing.

A specified movement amount of the bearing portion in response to a temperature difference between the temperature of the bearing portion and the temperature of the casing may be input to the control device in advance, and the control device may control the operation unit in accordance with the specified movement amount selected based on the temperature difference between the casing temperature and the bearing temperature.

The operation unit may include a hydraulic cylinder.

The gap adjustment unit may include a bolt that moves the bearing portion in the thrust direction.

The bolt may be provided as a pair of pressing and pulling bolts.

Meanwhile, the present invention provides a method of operating a gear pump including a casing that includes an inlet and an outlet, a pair of gear rotors each of which is formed by integrating a gear portion with a shaft portion and which is disposed so as to engage with each other inside the casing, and a bearing portion that supports the shaft portion so that the gear rotor is rotatable and is movable in the thrust direction as the axial direction of the gear rotor, the method including: measuring the temperatures of the bearing portion and the casing; and moving the bearing portion in the thrust direction based on the measured temperatures of the bearing portion and the casing.

The gear pump operating method may further include: preliminarily specifying a specified movement amount of the bearing portion in response to a temperature difference between the temperatures of the bearing portion and the casing: and moving the bearing portion in accordance with the specified movement amount selected based on the temperature difference between the temperatures of the bearing portion and the casing.

According to the gear pump and the gear pump operating method of the present invention, it is possible to highly precisely adjust the gap between the bearing portion and the gear rotor by a simple configuration.

DESCRIPTION OF THE PREFERRED EMBODIMENTS

Figure 1:
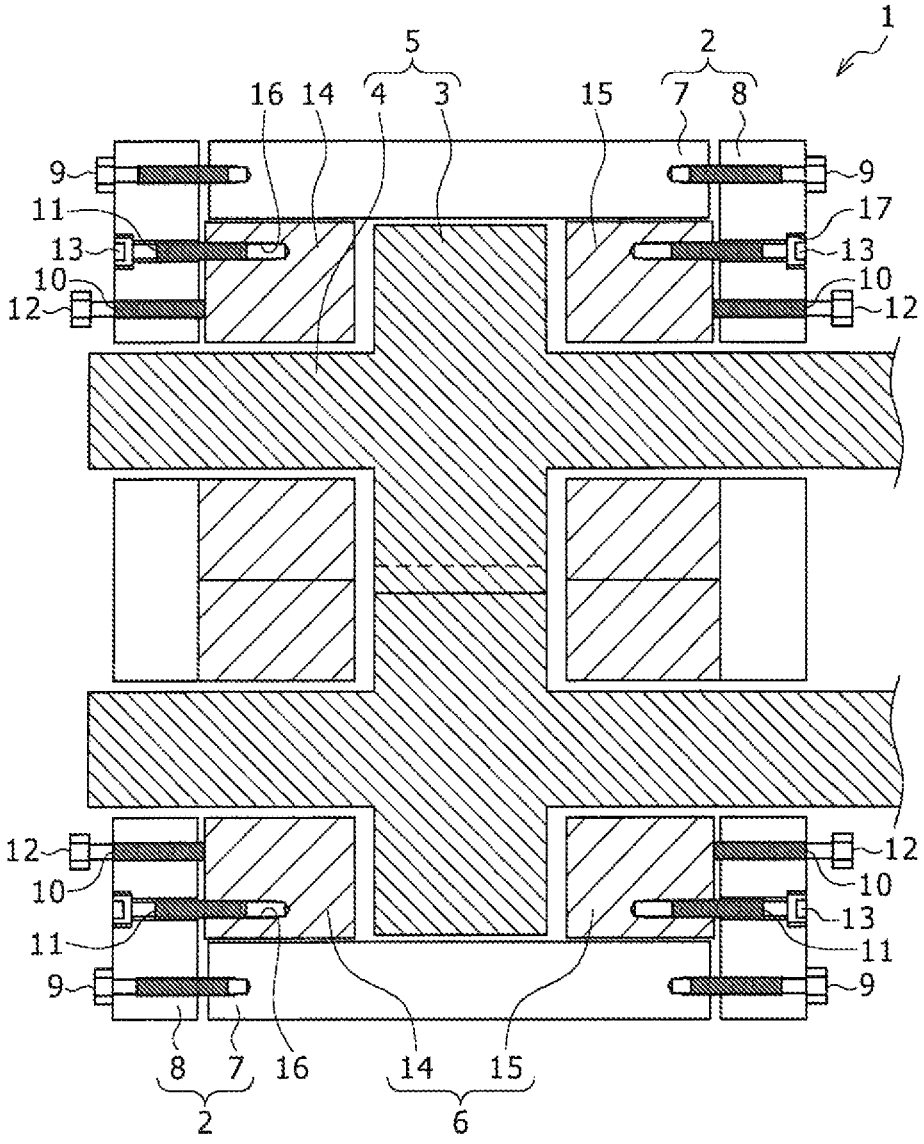
FIG. 1 is a schematic side view illustrating a gear pump of a first embodiment.

Referring to the drawings, a gear pump 1 according to an embodiment of the present invention will be described.

The gear pump 1 of this embodiment is provided at the downstream side of a kneading machine that knead a material (hereinafter, referred to as a resin material) such as a resin, and sends the kneaded material to a pelletizer or the like.

Specifically, as illustrated in FIG. 1, the gear pump 1 includes a casing 2 which is provided with an inlet (not illustrated) and an outlet (not illustrated), a pair of gear rotors 5 and 5 each of which is formed by integrating a gear portion 3 and a shaft portion 4 with each other and which is disposed so as to engage with each other inside the casing 2, and, a bearing portion 6 which supports the shaft portion 4 so that the gear rotor 5 is rotatable.

In addition, the gear rotor 5 may be formed by shrink-fitting the gear portion 3 to the shaft portion 4 or may be formed by integrally molding (monolithically molding) the gear portion 3 and the shaft portion 4. That is, both the gear portion 3 and the shaft portion 4 may be integrated with each other, and the manufacturing method (the method of integrating the gear portion 3 and the shaft portion 4 with each other) is not limited.

The gear rotors 5 are elongated rod-shaped members in the horizontal direction, and are provided as a pair of gear rotors arranged in the up and down direction.

Each gear rotor 5 includes the shaft portion 4 that is disposed so as to be rotatable while facing the center in the horizontal direction and the gear portion 3 that is formed at the halfway position in the longitudinal direction of the shaft portion 4. One end side (the base end side) of the shaft portion 4 is connected to a driving mechanism (not illustrated), and the shaft portion 4 is rotationally driven by the driving mechanism. Further, the other end side (the front end side) of the shaft portion 4 is attached so as to slightly protrude outward from the side surface of the casing 2.

The gear portion 3 of the gear rotor 5 is formed in a disk shape having a diameter larger than that of the shaft portion 4, and the outer peripheral end surface thereof is provided with a plurality of gear teeth in the circumferential direction. A gap between the gear teeth is formed in a concave shape so that the resin material may be held between the gap and the inner peripheral surface of the casing 2. Then, when the gear portion 3 is rotated along with the shaft portion 4, the resin material that is held between the gap of the gear teeth and the inner peripheral surface of the casing 2 may be pressure-fed.

Further, the lower gear teeth provided in the upper gear rotor 5 and the upper gear teeth provided in the lower gear rotor 5 engage with each other in the up and down direction.

In addition, the gear portion 3 of the gear rotor 5 is rotatably supported by the bearing portions 6 while being interposed between the bearing portion 6 at the front side (the opposite driving mechanism side) and the bearing portion 6 at the rear side (the driving mechanism side). The bearing portions 6 will be described later.

The casing 2 is formed in a cylindrical shape of which the inside is hollow, and the gear rotor 5 or the bearing portion 6 is accommodated therein. The casing 2 is provided with the inlet through which the resin material is inserted into the casing 2 and the outlet through which the inserted resin material is extracted to the outside of the casing 2. The inlet and the outlet are opened from the side surface of the casing 2 so as to face a direction perpendicular to the axis center of the gear rotor 5. Then, the resin material is supplied to the gap (the engagement portion) between the upper and lower gear rotors 5 through the inlet, and the resin material is discharged through the outlet.

The casing 2 includes a cylindrical casing body 7 of which both ends in the axial direction are opened and a bearing retainer 8 which is attached while being fitted into the openings of both ends of the casing body 7.

The casing body 7 is a cylindrical member that is shorter than the axial length of the gear rotor 5, and is provided so that the axis center faces the horizontal direction. The halfway position of the casing body 7 in the horizontal direction is formed so as to surround a portion corresponding to both the bearing portion 6 and the gear portion 3 of the gear rotor 5. Further, the opening of the casing body 7 is formed in a size in which the gear rotor 5 or the bearing portion 6 may be inserted toward both the front end side and the base end side of the gear rotor 5 in the axial direction.

The bearing retainer 8 is a plate-shaped member that is disposed in the up and down direction (a direction perpendicular to the shaft), and is attached to the edge of the casing body 7 by the use of a fastening tool 9 such as a bolt so as to close each of the openings formed at both ends of the casing body 7 in the axial direction. The bearing portion 6 is disposed on the surface of the bearing retainer 8 facing the gear portion 3. The bearing portion 6 is accommodated inside the casing 2 while the movement thereof in the axial direction is regulated by the bearing retainer 8, and is accommodated while being press-inserted by the bearing retainer 8.

Further, the bearing retainer 8 is provided with a plurality of penetration holes that penetrate the bearing retainer 8 in the axial direction. The plurality of penetration holes include a first penetration hole 10 that is formed so as to be close to the axis center of the casing body 7 and a second penetration hole 11 that is formed so as to be away from the axis center of the casing both 7, a pressing bolt 12 of the pressing, and pulling bolts to be described later is inserted through the first penetration hole 10, and a pulling bolt 13 of the pressing and pulling bolts to be described later is inserted through the second penetration hole 11.

The bearing portion 6 includes a front end side bearing portion 14 that is formed at the front end side (the opposite driving mechanism side) in the axial direction with respect to the gear portion 3 and a base end side bearing portion 15 that is formed at the base end side (the driving mechanism side) in the axial direction, and in this embodiment, a self-lubrication slide bearing is used in any bearing portion. The bearing portion 6 is formed in an annular shape so as to be coaxial with the gear rotor 5, and rotatably supports the gear rotor 5 with respect to the bearing retainer 8 (the casing body 7).

The gear pump 1 of this embodiment is formed so that the bearing portion 6 is movable in the thrust direction of the gear rotor 5. In other words, the gear pump 1 of this embodiment includes a gap adjustment unit that adjusts the gap between the gear rotor 5 and the bearing portion 6 by moving the bearing portion 6 in the thrust direction. When such a gap adjustment unit is provided, the gap between the gear rotor 5 and the bearing portion 6 may be appropriately adjusted, and the gear rotor 5 may be satisfactorily rotated while appropriately maintaining the gap even when heat is generated inside the gear pump 1. Accordingly, the size or the speed of the gear pump 1 may be increased.

Next, the gap adjustment unit as the feature of the gear pump 1 of the present invention will be described in detail.

In addition, various units may be employed as the gap adjustment unit of the present invention, and may include a unit that moves the bearing portion 6 by the use of the pressing and pulling bolts and a unit that moves the bearing portion 6 by the use of a hydraulic cylinder 18. In the first embodiment below, the gear pump 1 of the present invention will be described by exemplifying a unit that adjusts the gap between the gear rotor 5 and the bearing portion 6 by the use of the pressing and pulling bolts.

Figure 2:
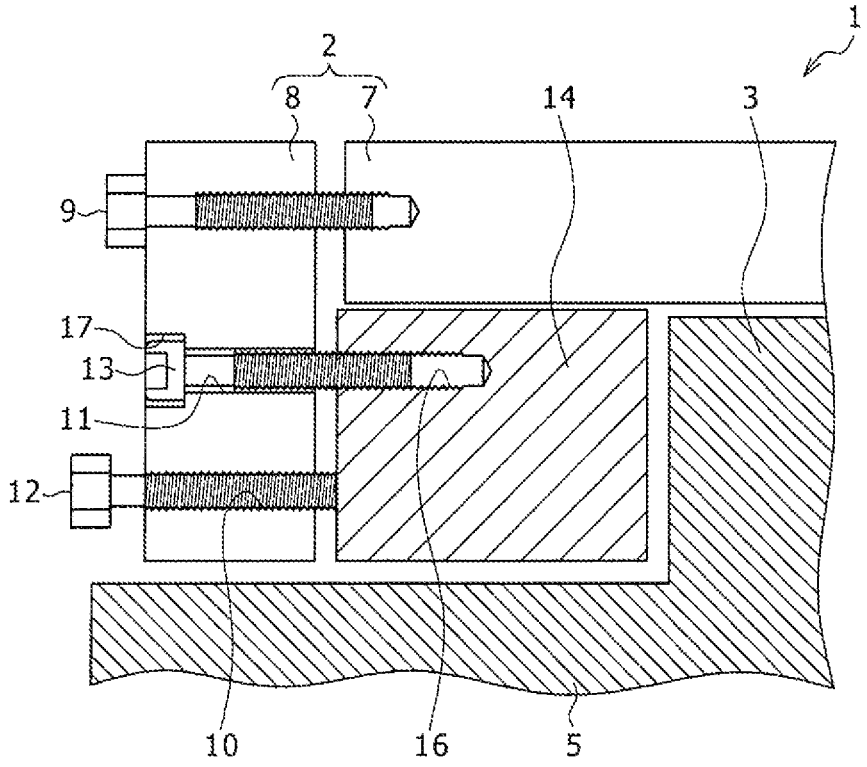
FIG. 2 is an enlarged view illustrating a bearing portion of the gear pump of the first embodiment.

As illustrated in FIGS. 1 and 2, the pressing and pulling bolts is used to move the bearing portion 6 in the thrust direction with respect to the casing 2, that is the bearing retainer 8. Specifically, the pressing and pulling bolts includes the pressing bolt 12 that presses the bearing portion 6 inward from the outside of the bearing retainer 8 and the pulling bolt 13 that pulls the bearing portion 6 outward from the inside of the bearing retainer 8.

In these two bolts, the pressing bolt 12 is disposed at the far side (the outside in the radial direction) with respect to the axis center of the gear rotor 5, and the pulling bolt 13 is disposed at the close side (the inside in the radial direction) with respect to the axis center of the gear rotor 5.

Further, the pressing bolt 12 is a bolt that is inserted through the first penetration hole 10 of the hearing retainer 8. The outer peripheral surface of the pressing bolt 12 is provided with a male screw portion. Meanwhile, the inner peripheral surface of the first penetration hole 10 through which the pressing bolt 12 is inserted is provided with a female screw portion that may be threaded into the male screw portion. Then, the front end of the pressing bolt 12 is formed in a spherical surface shape or a flat surface shape so that the bearing portion 6 may be easily pressed, and the base end of the pressing bolt 12 is formed as a screw head having a shape (for example, a hexagonal columnar shape) so that the base end may be rotated by a tool or the like.

That is, when the screw head of the pressing bolt 12 is rotated about the axis in one direction (for example, the clockwise direction when viewed from the screw head) by the use of a tool or the like, the pressing bolt 12 advances toward the inside of the bearing retainer 8 (the inside of the first penetration hole 10). Then, the front end of the flat pressing bolt 12 advances while contacting the bearing portion 6, so that the bearing portion 6 is pressed in a direction moving away from the bearing retainer 8.

Further, when the screw head of the pressing bolt 12 is rotated about the axis in the other direction (for example, the counterclockwise direction when viewed from the screw head) by the use of a tool or the like, the pressing bolt 12 retreats toward the outside of the bearing retainer 8 (the front side of the first penetration hole 10), so that the front end of the pressing bolt 12 and the bearing portion 6 are separated from each other in the axial direction. In this way, when the front end of the pressing bolt 12 and the bearing portion 6 are separated from each other, the pressing bolt 12 does not cause any disturbance when the bearing portion 6 is pulled toward the bearing retainer 8 by the pulling bolt 13.

As illustrated in FIG. 2, the pulling bolt 13 is a bolt that is inserted through the second penetration hole 11. The outer peripheral surface of the pulling bolt 13 is also provided with a male screw portion as in the case of the pressing bolt 12. However, as not in the case of the pressing bolt 12, the inner peripheral surface of the second penetration hole 11 through which the pulling bolt 13 is inserted is not provided with a female screw portion.

That is, the female screw portion that is threaded into the male screw portion of the pulling bolt 13 is formed in not the inner peripheral surface of the second penetration hole 11, but the inner peripheral surface of the third penetration hole 16. The third penetration hole 16 is formed in the surface (the side surface) of the bearing portion 6 corresponding to the opening of the second penetration hole 11 so as to communicate with the second penetration hole 11. The third penetration hole 16 extends from the outer side surface of the bearing portion 6 in the horizontal direction toward the inside of the bearing portion 6, and the front end thereof reaches the inside of the vicinity of the center of the bearing portion 6. Then, the inner peripheral surface of the third penetration hole 16 is provided with a female screw portion that is threaded into the male screw portion of the pulling bolt 13.

Further, the opening of the second penetration hole 11 is provided with an accommodation portion 17 into which the screw head of the pulling bolt 13 may be inserted. Further, the inner diameter of the second penetration hole 11 is formed so as to be slightly larger than the outer diameter of the male screw portion of the pulling bolt 13.

That is, when the screw head of the pulling bolt 13 is rotated about the axis in one direction by the use of a tool or the like, the accommodation portion 17 is inserted into the screw head, and the pulling bolt 13 advances toward the inside of the third penetration hole 16 until the root portion of the screw head contacts the bottom portion of the accommodation portion 17. Then, when the screw head of the pulling bolt 13 is further rotated in one direction while the root portion of the screw head contacts the bottom portion of the accommodation portion 17 (in other words, the axial position of the pulling bolt 18 is defined at a predetermined position) a force acts on the bearing portion 6 so that the bearing portion is pulled toward the bearing retainer 8. At this time, when the front end of the pressing bolt 12 and the bearing portion 6 are separated from each other, the bearing portion 6 may be pulled toward the bearing retainer 8.

Meanwhile, when the screw head of the pulling bolt 13 is rotated about the axis in the other direction by the use of a tool or the like, the pulling bolt 13 is retracted from the inside the third penetration hole 16 toward the front side (the outside), and the root portion of the screw head of the pulling bolt 13 is separated from the bottom portion of the accommodation portion 17 in the axial direction. In this way, when the root portion of the screw head of the pulling bolt 13 is lifted from the bottom portion of the accommodation portion 17, the bearing portion 6 and the bearing retainer 8 may be further separated from each other by the pressing bolt 12 with the rotation of the pressing bolt 12.

Next, a method of adjusting the gap between the gear rotor 5 and the bearing portion 6 using the gap adjustment unit, that is a method of operating the gear pump 1 of the present invention will, be described.

First, a case will be supposed in which the gap between the gear rotor 5 and the bearing portion 6 is narrowed by using the gap adjustment unit in the "non-adjusted" gear pump 1.

In such a case, in the pressing and pulling bolts of the gap adjustment unit, the pressing bolt 12 is rotated in one direction, and the pulling bolt 13 is rotated in the other direction. Then, the pressing bolt 12 advances toward the inside of) the bearing portion 6 so that the bearing portion 6 is pressed by the front end of the pressing bolt 12, and hence the gap between the gear rotor 5 and the bearing portion 6 may be narrowed. Further, when the pulling bolt 13 is rotated further in the other direction, the pulling bolt 13 retreats toward the opposite side compared to the case where the bearing portion 6 is pressed by the front end of the pressing bolt 12, and the root portion of the screw head of the pulling bolt 13 is separated from the bottom portion of the accommodation portion 17 formed in the opening of the second penetration hole 11, so that no regulation occurs by the pulling bolt 13. Accordingly, the bearing portion 6 may be moved in a direction in which the gap between the gear rotor 5 and the bearing portion 6 is further narrowed.

Next, as illustrated in FIG. 2, a case will be supposed in which the gap between the gear rotor 5 and the bearing portion 6 is widened by using the gap adjustment unit.

That is, in the pressing and pulling bolts of the gap adjustment unit, the pressing bolt 12 is rotated in the other direction, and the pulling bolt 13 is rotated in one direction. Then, the pressing bolt 12 is retracted from the bearing portion 6, so that the front end of the pressing bolt 12 is separated from the bearing portion 6. As a result, the regulation of the pressing bolt 12 does not occur, so that the gap between the gear rotor 5 and the bearing portion 6 may be widened. Then, when the pulling bolt 13 is further rotated in one direction, the bearing portion 6 may be pulled toward the bearing retainer 8.

As described above, in the gear pump 1 of the present invention, the bearing portion 6 is movable in the thrust direction by the use of the gap adjustment unit using the pressing and pulling bolts. For this reason, even when a gap is formed between the bearing portion 6 and the gear rotor 5 due to the thermal expansion difference or the production resin type or the operation condition is changed, the gap may be adjusted with high precision.

Therefore, it is possible to always optimize the efficiency of the gear pump 1 in which the gap between the bearing portion 6 and the gear rotor 5 easily changes. Accordingly, it is possible to minimize the power loss caused by the degradation in the efficiency of a pump 23 as in the case of the related art.

Further, it is possible to decrease the amount of the resin leaking to the gap between the bearing portion 6 and the gear rotor 5 while optimally maintaining the gap by using the gap adjustment unit, and hence to prevent the degradation of the resin caused by the shearing heat.

Furthermore, it is possible to prevent a problem in which the gap between the bearing portion 6 and the gear rotor 5 is narrowed so that the bearing portion 6 and the gear rotor 5 contact each other due to a temperature difference between the hearing portion 6 and the gear rotor 5.

Further, since there is no need to employ a complex mechanism such as a hydraulic cylinder, the gap between the bearing portion 6 and the gear rotor 5 may be adjusted by modifying the existing facility, and hence the gap may be adjusted without increasing the cost.

Next, the gear pump 1 of a second embodiment will be described.

Figure 3:
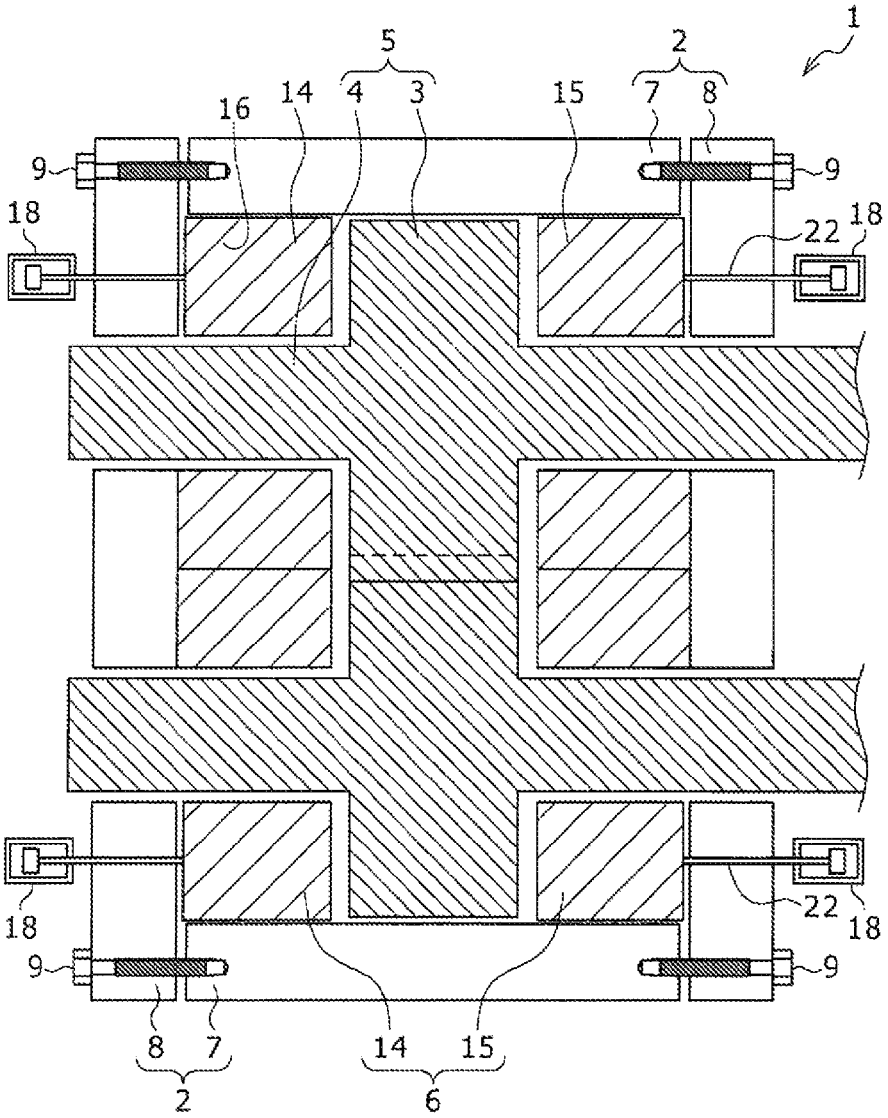
FIG. 3 is a schematic side view illustrating a gear pump of a second embodiment.
Figure 4:
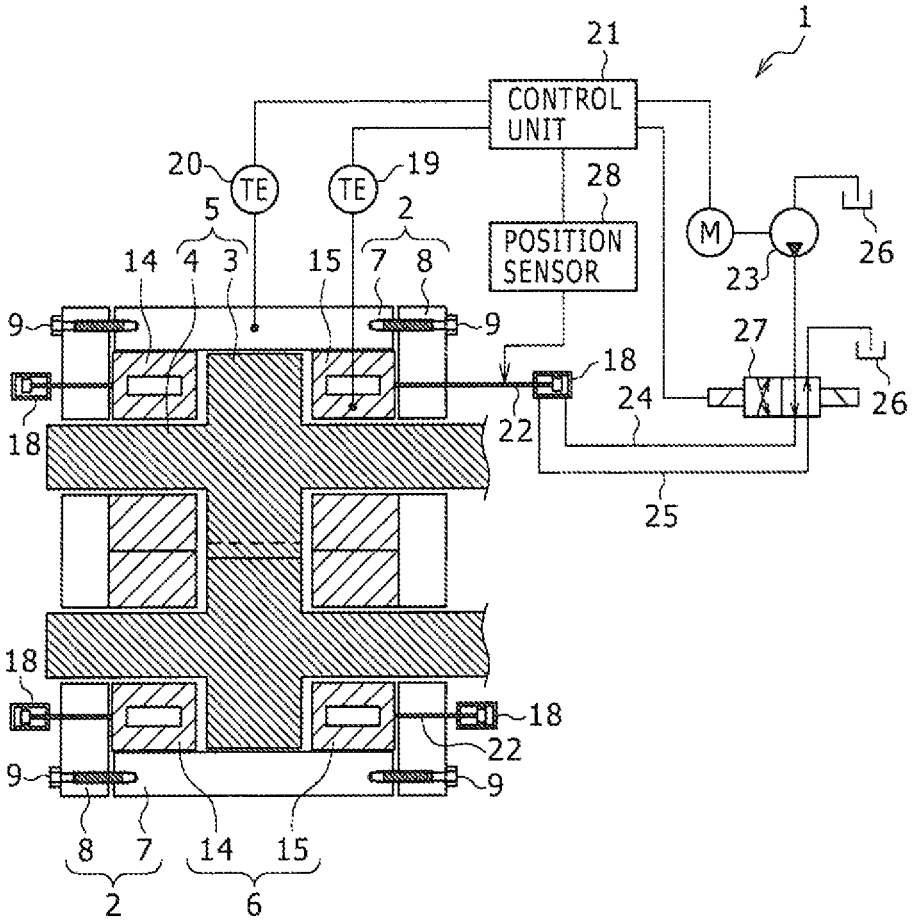
FIG. 4 is a schematic side view illustrating a gear pump of a third embodiment.

As illustrated in FIGS. 3 and 4, the gear pump 1 of the second embodiment uses the hydraulic cylinder 18 as the unit for moving the bearing portion 6 instead of the pressing and pulling bolts. Further, the gear pump 1 of the second embodiment actually measures the temperature (the bearing temperature) of the bearing portion 6 and the temperature (the casing temperature) of the casing 2 and controls the telescopic amount of the hydraulic cylinder 18 so that the gap between the bearing portion 6 and the casing 2 is optimized in response to the measured bearing temperature and the measured casing temperature (or the temperature difference therebetween).

Next, a bearing temperature measurement unit 19, a casing temperature measurement unit 20, a control unit 21, and the hydraulic cylinder 18 constituting the gear pump 1 of the second embodiment will be described.

As illustrated in FIG. 4, the bearing temperature measurement unit 19 is formed as a temperature sensor such as a thermocouple, and is provided in the bearing portion 6 so as to actually measure the temperature of the bearing portion 6. That is, when the bearing temperature and the casing temperature are largely different from the supposed temperatures or a temperature difference between the bearing portion 6 and the casing 2 increases, there is a possibility that the gap between the bearing portion 6 and the gear rotor 5 may change, and hence the temperature of the bearing portion 6 is actually measured by the bearing temperature measurement unit 19.

Specifically, the bearing temperature measurement unit 19 is attached to a position (on the inside in the radial direction) close to the inner peripheral surface of the bearing portion 6 that is easily influenced by the temperature of the gear rotor 5 even in the bearing portion 6. The temperature that is measured by the bearing temperature measurement unit 19 is transmitted to the control unit 21.

The casing temperature measurement unit 20 is formed as a temperature sensor such as a thermocouple as in the bearing temperature measurement unit 19, and is provided in the casing 2 so as to actually measure the temperature of the casing 2. Specifically, the casing temperature measurement unit 20 is attached to a portion of the casing body 7 facing the outer periphery of the gear portion 3 (of the gear rotor 5) of the casing body 7 inside the casing 2. More specifically, the casing temperature measurement unit 20 is attached to the center of the casing body 7 in the axial direction (the horizontal direction). The temperature that is measured by the casing temperature measurement unit 20 is also transmitted to the control unit 21.

As illustrated in FIGS. 3 and 4, the hydraulic cylinder 18 is provided so as to correspond to each of four bearing portions 6 rotatably supporting the upper and lower gear rotors 5. Each hydraulic cylinder 18 includes a rod (a piston rod) 22 that is movable in the axial direction by the pressure applied to the cylinder portion. The front end of the rod 22 is connected to the bearing portion 6, and the hydraulic cylinder 18 moves the bearing portion 6 in the axial direction by moving the rod 22 in a telescopic manner in the axial direction.

Each hydraulic cylinder 18 is provided with a pipe that supplies oil pressurized by the pump 23 to the hydraulic cylinder 18. Specifically, each hydraulic cylinder 18 is provided with a first pipe 24 through which hydraulic oil pressurized by the pump 23 is supplied to the base end side (the side without the rod 22) of the cylinder portion of the piston and a second pipe 25 through which the pressurized hydraulic oil is supplied to the front end side (the projection side of the rod 22) of the cylinder portion of the piston.

A switching valve 27 that switches each pipe to the pump 23 and the oil storage tank 26 is provided in the middle of the first pipe 24 and the second pipe 25.

For example, when the switching valve 27 is switched to one side, the first pipe 24 communicates with the pump 23, and the second pipe 25 communicates with the oil storage tank 26. For this reason, the hydraulic oil is supplied to the base end side of the cylinder portion of the piston, so that the rod 22 extends.

Further, when the switching valve 27 is switched to the other side, the second pipe 25 communicates with the pump 23, and the first pipe 24 communicates with the oil storage tank 26. For this reason, the hydraulic oil is supplied to the front end side of the cylinder portion of the piston, so that the rod 22 contracts and retreats.

In addition, the rod 22 of the hydraulic cylinder 18 is provided with a position sensor 28 that may measure the telescopic amount of the rod 22 in the axial direction. The telescopic amount of the hydraulic cylinder 18 measured by the position sensor 28 is transmitted to the control unit 21 as a signal.

In the control unit 21, the storage unit stores in advance data corresponding to the linear expansion coefficient $\alpha$ of the material forming the gear rotor 5 (particularly, the gear portion 3) and the linear expansion coefficient $\beta$ of the material forming the bearing portion 6. The control unit 21 calculates the supposed distance of the gap between the bearing portion 6 and the gear rotor 5 based on the linear expansion coefficients $\alpha$ and $\beta$, the casing temperature transmitted from the casing temperature measurement unit 20, and the bearing temperature transmitted from the bearing temperature measurement unit 19. Then, the movement amount of the bearing portion 6 in the thrust direction, that is, the telescopic amount of the hydraulic cylinder 18 is calculated so that the calculated distance of the gap between the hearing portion 6 and the gear rotor 5 becomes a predetermined gap amount, and the movement amount of the hydraulic cylinder 18 is calculated so that the telescopic amount of the hydraulic cylinder 18 actually measured by the position sensor 28 becomes the calculated telescopic amount.

Next, in the control unit 21, the hydraulic cylinder 18 as the gap adjustment unit is moved in a telescopic manner based on the movement amount of the bearing portion 6 which is obtained by the above-described calculation and the telescopic amount of the hydraulic cylinder 18 so that the actual distance of the gap between the bearing portion 6 and the gear rotor 5 becomes a predetermined gap amount. For example, the bearing portion 6 is pressed into the casing 2 in a manner such that the switching valve 27 is switched to one side so that the rod 22 extends. Alternatively, the bearing portion 6 is returned to the outside of the casing 2 in a manner such that the switching valve 27 is switched to the other side so that the rod 22 contracts and retreats. The telescopic amount of the hydraulic cylinder 18 is measured by the position sensor 28, and is fed back to the control unit 21.

In this way, when the bearing portion 6 is moved by using the gap adjustment unit so that the gap between the bearing portion 6 and the gear rotor 5 becomes a predetermined gap amount, the amount of the resin material leaking from the gap between the bearing portion 6 and the gear rotor 5 may be minimized even when the operation condition of the gear pump 1 continuously changes, and hence the degradation of the resin caused by the shearing heat may be prevented.

In addition, the movement amount (the specified movement amount) of the bearing portion 6 is specified in advance in response to the temperature difference between the temperature of the bearing portion 6 and the temperature of the casing 2, the specified movement amount is input to the gap adjustment unit (more specifically, the control unit 21) in advance, a predetermined specified movement amount is selected based on the temperature difference between the temperatures of the bearing portion 6 and the casing 2 from the specified movement amount input in advance, and the bearing portion 6 is moved in accordance with the selected specified movement amount.

In this case, the storage unit of the control unit 21 receives and stores the data of the specified movement amount in advance. Then, the control unit 21 calculates the temperature difference based on the casing temperature transmitted from the casing temperature measurement unit 20 and the bearing temperature transmitted from the bearing temperature measurement unit 19. Further, the control unit 21 selects an appropriate specified movement amount in response to the calculated temperature difference from the calculated temperature difference and the stored specified movement amount. Then, the control unit 21 and the gap adjustment unit move the bearing portion 6 in accordance with the selected specified movement amount. This is particularly effective in a case where the linear expansion coefficient $\alpha$ of the material forming the gear rotor 5 (in particular, the gear portion 3) is identical or similar to the linear expansion coefficient $\beta$ of the material forming the bearing portion 6 and the temperature of the casing 2 close to the temperature of the gear rotor 5.

By employing the above-described gap adjustment unit, the gap between the bearing portion 6 and the casing 2 is adjusted to an optimal value in response to such temperatures for the temperature difference thereof). As a result, even when a gap is formed between the bearing portion 6 and the gear rotor 5 due to the thermal expansion difference or the resin type or the production condition is changed, the gap may be adjusted with high precision.

In addition, it should be considered that the embodiments disclosed herein are merely examples in all respects and do not limit the present invention. In particular, the items which are not apparently disclosed in the embodiments herein, for example, the operation condition, the work condition, various parameters, and the dimension, the weight, and the volume of the component are set to the values which may be easily supposed by the person skilled in the art without departing from the scope of the person skilled in the art.

What is claimed is:

1. A gear pump comprising:

a casing that includes an inlet and an outlet;

a pair of gear rotors each of which is formed by integrating a gear portion with a shaft portion and which is disposed so as to engage with each other inside the casing;

a bearing portion that supports the shaft portion so that the pair of gear rotors is rotatable, the bearing portion being movable in an axial direction of the pair of gear rotors; and a gap adjustment unit that moves the bearing portion in the axial direction so as to adjust a gap between the pair of gear rotors and the bearing portion, wherein the gap adjustment unit includes;

a bearing temperature measurement unit that is provided in the bearing portion so as to measure the temperature of the bearing portion;

a casing temperature measurement unit that is provided in the casing so as to measure the temperature of the casing;

an operation unit that moves the bearing portion in the axial direction; and a controller that controls the operation unit based on the temperature of the bearing measured by the bearing temperature measurement unit and the temperature of the casing measured by the casing temperature measurement unit.

2. The gear pump according to claim 1, wherein the bearing temperature measurement unit is attached to the inside of the bearing portion in the radial direction.

3. The gear pump according to claim 1, wherein the casing temperature measurement unit is attached to a portion facing the outer periphery of the gear portion in the casing.

4. The gear pump according to claim 1, wherein a specified movement amount of the bearing portion in response to a temperature difference between the temperature of the bearing portion and the temperature of the casing is input to the controller in advance, and the controller controls the operation unit in accordance with the specified movement amount selected based on the temperature difference between the casing temperature and the bearing temperature.

5. The gear pump according to claim 1, wherein the operation unit includes a hydraulic cylinder.

6. A method of operating a gear pump including a casing that includes an inlet and an outlet, a pair of gear rotors each of which is formed by integrating a gear portion with a shaft portion and which is disposed so as to engage with each other inside the casing, and a bearing portion that supports the shaft portion so that the pair of gear rotors is rotatable and is movable in the thrust direction as the axial direction of the pair of gear rotors, the method comprising:

measuring the temperatures of the bearing portion and the casing; and moving the bearing portion in the thrust direction based on the measured temperatures of the bearing portion and the casing.

7. The method according to claim 6, further comprising:

preliminarily specifying a specified movement amount of the bearing portion in response to a temperature difference between the temperatures of the bearing portion and the casing; and moving the bearing portion in accordance with the specified movement amount selected based on the temperature difference between the temperatures of the bearing portion and the casing.

* * * * *